US011056814B2

(12) United States Patent
Sugiyama et al.

(10) Patent No.: US 11,056,814 B2
(45) Date of Patent: Jul. 6, 2021

(54) CONNECTOR WITH A PLURALITY OF CONDUCTIVE ELASTIC MEMBERS TO SECURE AN INSERTED CONNECTION MEMBER

(71) Applicant: KYOCERA Document Solutions Inc., Osaka (JP)

(72) Inventors: Yuichi Sugiyama, Osaka (JP); Minoru Shinba, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/796,672

(22) Filed: Feb. 20, 2020

(65) Prior Publication Data

US 2020/0303855 A1 Sep. 24, 2020

(30) Foreign Application Priority Data

Mar. 22, 2019 (JP) ..... JP2019-054588

(51) Int. Cl.

| | |
|---|---|
| ***H01R 13/187*** | (2006.01) |
| ***H01R 12/79*** | (2011.01) |
| ***H01R 13/24*** | (2006.01) |
| ***H01R 12/77*** | (2011.01) |
| ***H01R 13/641*** | (2006.01) |
| ***H01R 13/703*** | (2006.01) |

(52) U.S. Cl.

CPC ..... *H01R 13/187* (2013.01); *H01R 12/774* (2013.01); *H01R 12/79* (2013.01); *H01R 13/2414* (2013.01); *H01R 13/641* (2013.01); *H01R 13/703* (2013.01)

(58) Field of Classification Search

CPC .. H01R 13/187; H01R 12/79; H01R 13/2414; H01R 12/774; H01R 12/772; H01R 12/778; H01R 12/77; H01R 12/59; H01R 13/6271; H01R 13/641; H01R 12/72; H01R 12/721; H01R 13/717; H01R 13/7175; H01R 13/70; H01R 13/703

USPC ..... 439/495, 325, 327, 328, 329, 315, 489, 439/490

See application file for complete search history.

(56) References Cited

U.S. PATENT DOCUMENTS 4,106,841 A * 8/1978 Vladic ..... H01R 23/70 439/188
4,285,565 A * 8/1981 Kirby ..... H01R 12/721 439/637
4,514,030 A * 4/1985 Triner ..... H01R 12/721 439/188

(Continued)

FOREIGN PATENT DOCUMENTS

JP H05-072083 U 9/1993

*Primary Examiner* — Travis S Chambers
(74) *Attorney, Agent, or Firm* — Studebaker & Brackett PC

(57) ABSTRACT

A connector includes a connector body, a first elastic member, and a second elastic member. The connector body has an insertion hole that allows a connection member to be inserted thereinto. The connection member has a plate shape or a sheet shape. Each of the first and second elastic members is a conductive member that includes a base fixed to the connector body. The first and second elastic members are elongated in a thickness direction of the connection member and butted against each other so as to partially block the insertion hole. The thickness direction intersects an insertion direction of the connection member.

4 Claims, 5 Drawing Sheets

(56) References Cited

U.S. PATENT DOCUMENTS

| | | | | | |
|---|---|---|---|---|---|
| 5,064,388 | A * | 11/1991 | Paladel | H01R 13/6596 | 439/607.23 |
| 5,088,931 | A * | 2/1992 | Niciolo | H01R 13/7034 | 439/188 |
| 5,239,748 | A * | 8/1993 | Hamilton | H05K 1/117 | 29/843 |
| 5,259,768 | A * | 11/1993 | Brunker | H01R 13/6474 | 439/60 |
| 5,316,496 | A | 5/1994 | Imai | | |
| 5,533,907 | A * | 7/1996 | Kozel | H01R 13/7034 | 200/51.1 |
| 6,244,881 | B1 * | 6/2001 | Hara | H01R 13/7034 | 439/188 |
| 6,764,345 | B1 * | 7/2004 | Duesterhoeft | H01R 12/721 | 439/637 |
| 8,460,013 | B2 * | 6/2013 | Homer | H01R 13/6658 | 439/78 |
| 9,876,295 | B2 * | 1/2018 | Hori | H01R 12/7094 | |
| 10,122,126 | B2 * | 11/2018 | Gotz | H01R 13/04 | |
| 2004/0266268 | A1 * | 12/2004 | Arias | H04Q 1/142 | 439/637 |
| 2009/0291596 | A1 * | 11/2009 | Miyazoe | H01R 12/7017 | 439/636 |
| 2016/0079692 | A1 * | 3/2016 | Sasame | H01R 12/772 | 439/355 |

* cited by examiner

CONNECTOR WITH A PLURALITY OF CONDUCTIVE ELASTIC MEMBERS TO SECURE AN INSERTED CONNECTION MEMBER

INCORPORATION BY REFERENCE

The present application claims priority under 35 U.S.C. § 119 to Japanese Patent Application No. 2019-054588, filed on Mar. 22, 2019. The contents of this application are incorporated herein by reference in their entirety.

BACKGROUND

The present disclosure relates to a connector.

There is a known connection member that has a plate shape or a sheet shape. The connection member includes a flexible flat cable (FFC). Alternatively, the connection member includes a flexible printed circuit (FPC).

Robots have been actively introduced into processes of manufacturing electronic devices. The robots are capable of performing assembly work of inserting, into a connector, the connection member that has the plate shape or the sheet shape.

There is also a known connector including an insulation housing with a first opening, a second opening, and an FFC insertion opening. Each of contacts held by the insulation housing has a contact portion with a contact point, and a retainer preventing the contact from falling off. The FFC insertion opening communicates with the first opening. The contact portion protrudes into the first opening. The retainer is fixed by an inner wall of the second opening.

SUMMARY

A connector according to an aspect of the present disclosure includes a connector body, a first elastic member, and a second elastic member. The connector body includes an insertion hole that allows a connection member to be inserted thereinto. Here, the connection member has a plate shape or a sheet shape. The first elastic member is a conductive member that includes a base fixed to the connector body. The second elastic member is a conductive member that includes a base fixed to the connector body. The first and second elastic members are elongated in a thickness direction of the connection member and butted against each other so as to partially block the insertion hole. Here, the thickness direction intersects an insertion direction of the connection member.

DETAILED DESCRIPTION

Figure 1:
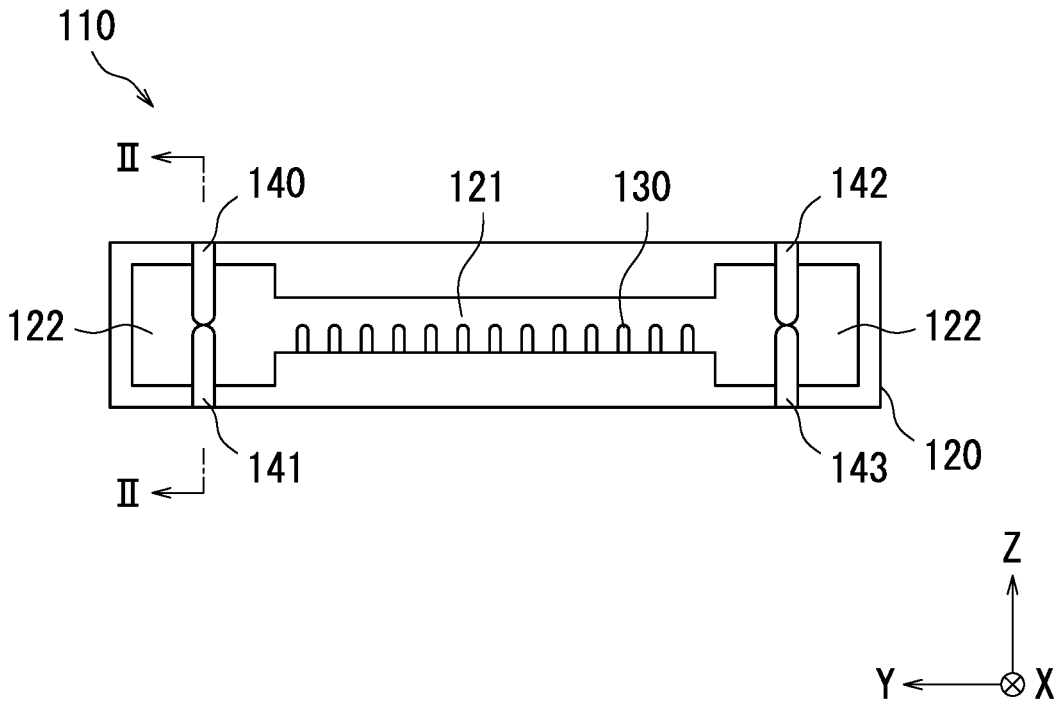
FIG. 1 is a front view of a connector according to an embodiment of the present disclosure.

An embodiment of the present disclosure will hereinafter be described with the accompanying drawings. In the present specification, an X axis, a Y axis, and a Z axis perpendicular to one another are defined for convenience. The X axis and the Y axis are parallel to a horizontal direction, and the Z axis is parallel to a vertical direction. In the drawings, the same or equivalent elements are allocated the same reference signs, and description thereof will not be repeated.

Figure 2:
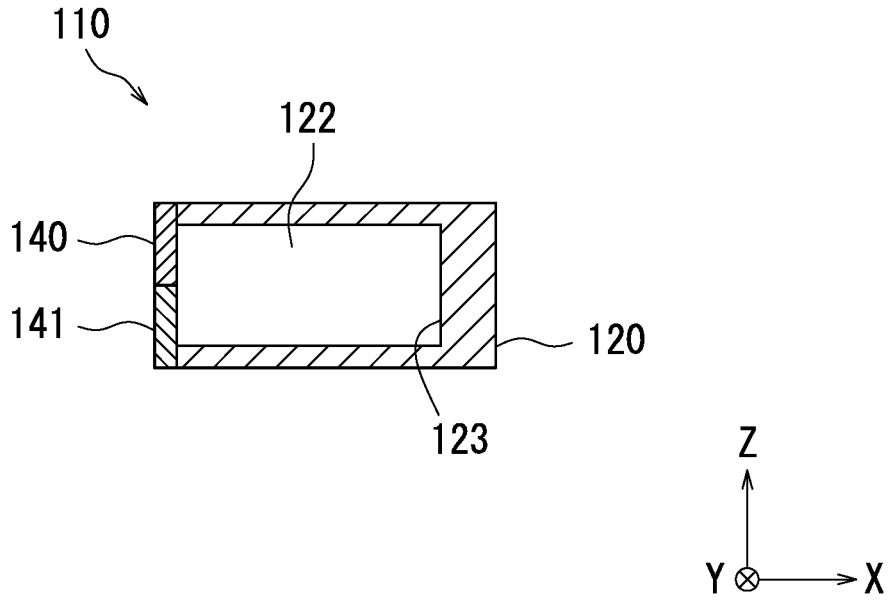
FIG. 2 is s cross-sectional view taken along a line II-11 in FIG. 1.

A connector 110 according to an embodiment will first be described with reference to FIGS. 1 and 2. FIG. 1 is a front view of the connector 110. FIG. 2 is a cross-sectional view taken along a line II-II in FIG. 1. The connector 110 allows a later-described FFC 10 to be inserted thereinto. The FFC 10 is one example of a connection member having a plate shape or a sheet shape.

As illustrated in FIGS. 1 and 2, the connector 110 includes a connector body 120, contacts 130, a first leaf spring 140, a second leaf spring 141, a third leaf spring 142, and a fourth leaf spring 143.

The connector body 120 has a central insertion hole 121 and respective end insertion holes 122 located at both ends of the connector body 120 in a Y-axis direction. Here, the end insertion holes 122 include a first end insertion hole 122 and a second end insertion hole 122. The central insertion hole 121 and the end insertion holes 122 communicate with each other.

The central insertion hole 121 is formed so that a width thereof in a Z-axis direction is narrower than that of each end insertion hole 122. The central insertion hole 121 and the end insertion holes 122 allow a central portion and end portions of the FFC 10 in the Y-axis direction to be inserted thereinto, respectively. The connector body 120 includes an inner wall 123 behind the central insertion hole 121 and the end insertion holes 122. The connector body 120 is made from for example resin.

The contacts 130 are supported behind the central insertion hole 121 by the connector body 120.

The first leaf spring 140 is an elastic member that has conductivity and that is formed in an elongated plate shape. A longitudinal direction of the first leaf spring 140 is parallel to the Z-axis direction. The first leaf spring 140 includes a base and a tip. The base is fixed to an edge of the first end insertion hole 122 of the end insertion holes 122. The tip is elongated from the base in a Z-axis negative direction so as to partially block the first end insertion hole 122.

The second leaf spring 141 is an elastic member that has conductivity and that is formed in an elongated plate shape. A longitudinal direction of the second leaf spring 140 is parallel to the Z-axis direction. The second leaf spring 141 includes a base and a tip. The base is fixed to an edge of the first end insertion hole 122. The tip is elongated from the base in a Z-axis positive direction so as to partially block the first end insertion hole 122. The elongated second leaf spring 141 is butted against the first leaf spring 140. That is, the tip of the second leaf spring 141 is in contact with the tip of the first leaf spring 140.

The first leaf spring 140 corresponds to one example of a "first elastic member". The second leaf spring 141 corresponds to one example of a "second elastic member".

The third leaf spring 142 is an elastic member that has conductivity and that is formed in an elongated plate shape. A longitudinal direction of the third leaf spring 142 is parallel to the Z-axis direction. The third leaf spring 142 includes a base and a tip. The base is fixed to an edge of the second end insertion hole 122 of the end insertion holes 122. The tip is elongated from the base in the Z-axis negative direction so as to partially block the second end insertion hole 122.

The fourth leaf spring 143 is an elastic member that has conductivity and that is formed in an elongated plate shape. A longitudinal direction of the fourth leaf spring 143 is parallel to the Z-axis direction. The fourth leaf spring 143 includes a base and a tip. The base is fixed to an edge of the second end insertion hole 122. The tip is elongated from the base in the Z-axis positive direction so as to partially block the second end insertion hole 122. The elongated fourth leaf spring 143 is butted against the third leaf spring 142. That is, the tip of the fourth leaf spring 143 is in contact with the tip of the third leaf spring 142.

The third leaf spring 142 corresponds to one example of a "third elastic member". The fourth leaf spring 143 corresponds to one example of a "fourth elastic member".

Figure 3:
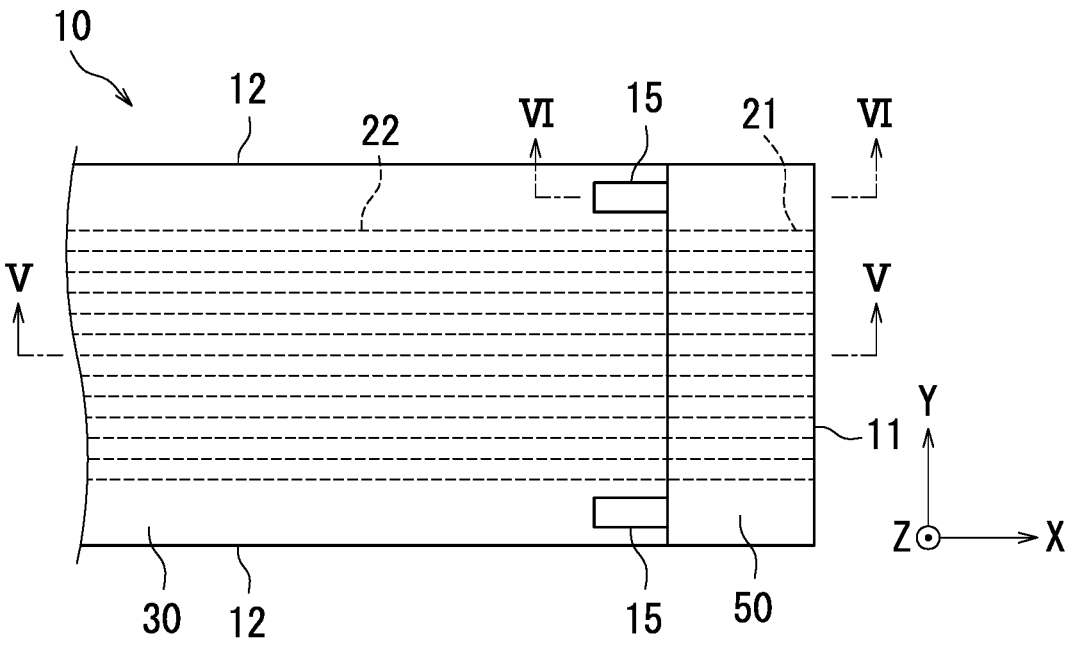
FIG. 3 is a plan view of an FFC that is one example of a connection member.
Figure 4:
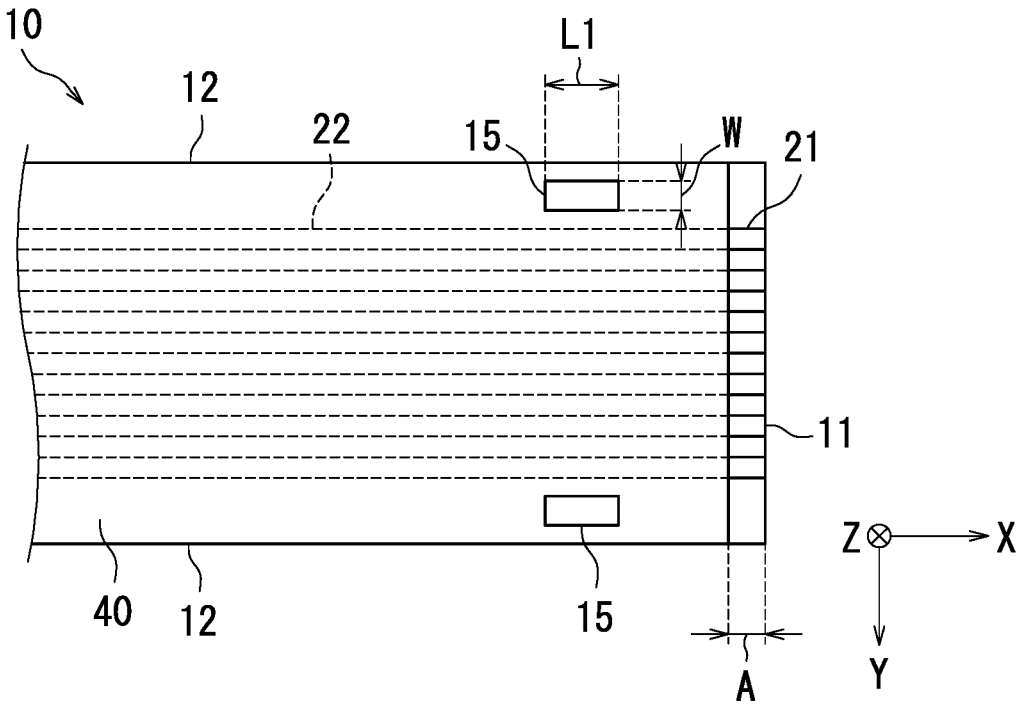
FIG. 4 is a back view of the FFC.
Figure 5:
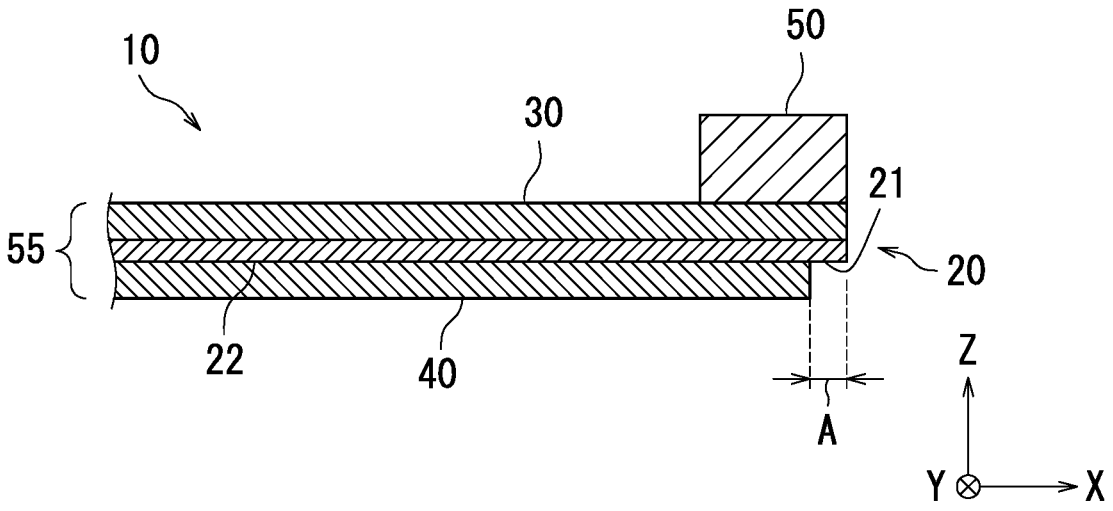
FIG. 5 is s cross-sectional view taken along a line V-V in FIG. 3.
Figure 6:
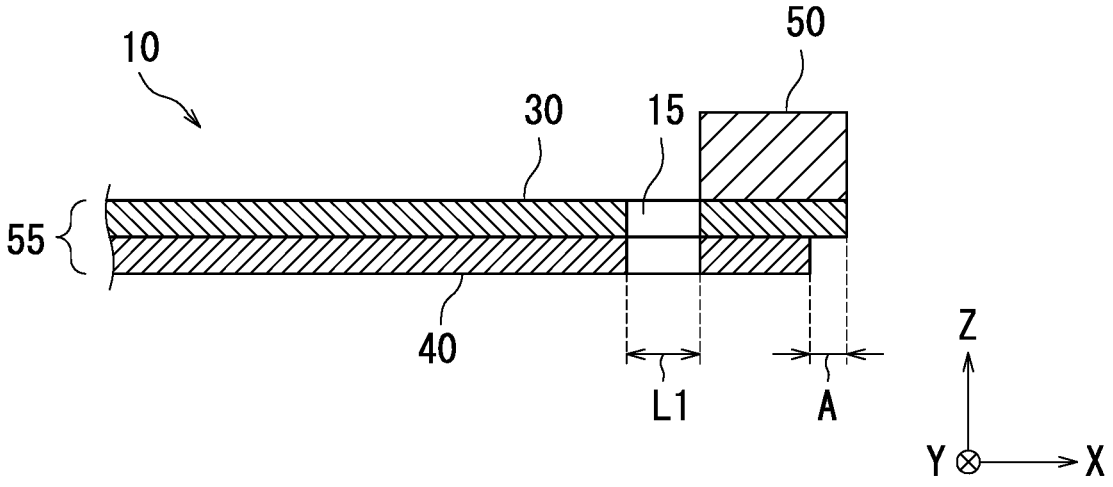
FIG. 6 is s cross-sectional view taken along a line VI-VI in FIG. 3.

The FFC 10 that is the one example of the connection member will next be described with reference to FIGS. 3 to 6. FIG. 3 is a plan view of the FFC 10. FIG. 4 is a back view of the FFC 10. FIG. 5 is a cross-sectional view taken along a line V-V in FIG. 3. FIG. 6 is a cross-sectional view taken along a line VI-VI in FIG. 3.

As illustrated in FIGS. 3 to 6, the FFC 10 has a plate shape or a sheet shape. A lengthwise direction of the FFC 10 matches an X-axis direction. A widthwise direction of the FFC 10 matches the Y-axis direction. Here, the widthwise direction intersects the lengthwise direction of FFC 10. A thickness direction of the FFC 10 matches the Z-axis direction. Here, the thickness direction intersects the lengthwise direction of FFC 10.

As illustrated in FIG. 5, the FFC 10 includes a signal layer 20, a first insulating layer 30, and a second insulating layer 40. The signal layer 20 is sandwiched between the first and second insulating layers 30 and 40. As illustrated in FIGS. 3, 4, and 5, terminals 21 and signal lines 22 are formed in the signal layer 20. Here, the number of the terminals 21 is the same as the number of the contacts 130 of the connector 110. The signal lines 22 are connected to the respective corresponding terminals 21.

As illustrated in FIGS. 4 and 5, the terminals 21 are positioned adjacent to an end 11 of the FFC 10 in an X-axis positive direction and exposed from the second insulating layer 40. Each of the terminals 21 has a terminal length A in the X-axis direction. The signal lines 22 extend away from the end 11 in an X-axis negative direction. As illustrated in FIGS. 3 and 4, the signal lines 22 extend parallel to two edges 12 of the FFC 10. The edges 12 are respectively located at both ends of the FFC 10 in the Y-axis direction.

As illustrated in FIGS. 3, 5, and 6, the FFC 10 further includes a reinforcement plate 50. The reinforcement plate 50 provides rigidity to the FFC 10. The reinforcement plate 50 is positioned adjacent to the end 11 and covers part of the first insulating layer 30. Portion of the FFC 10 except the reinforcement plate 50 may be referred to as a flexible portion 55.

As illustrated in FIGS. 3, 4, and 6, the FFC 10 further includes two through holes 15 each of which goes through the FFC 10 in the Z-axis direction. The through holes 15 are rectangular in shape. A longitudinal (lengthwise) direction of each through hole 15 is parallel to the X-axis direction. A widthwise direction of each through hole 15 is parallel to the Y-axis direction. Each through hole 15 has a dimension L1 in the lengthwise direction and a dimension W in the widthwise direction.

As illustrated in FIGS. 3 and 6, the through holes 15 are adjacent to the reinforcement plate 50 at a position farther from the end 11 than the terminals 21 in the X-axis direction. In addition, as illustrated in FIGS. 3 and 4, the through holes 15 are located at respective outer sides of the terminals 21 and the signal lines 22 in the Y-axis direction.

Figure 7:
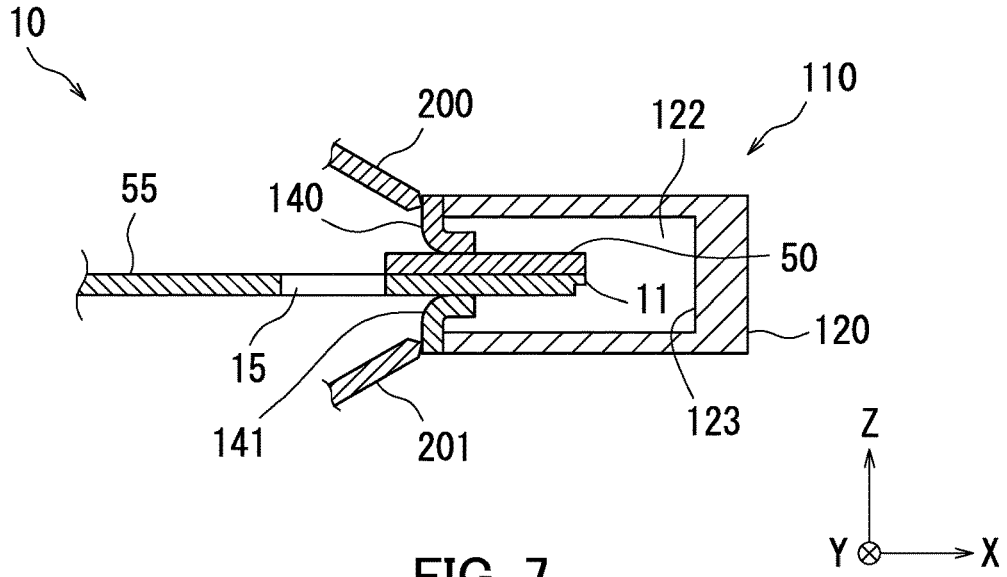
FIG. 7 is a cross-sectional view of the connector and the FFC in the process of insertion of the FFC into the connector.
Figure 8:
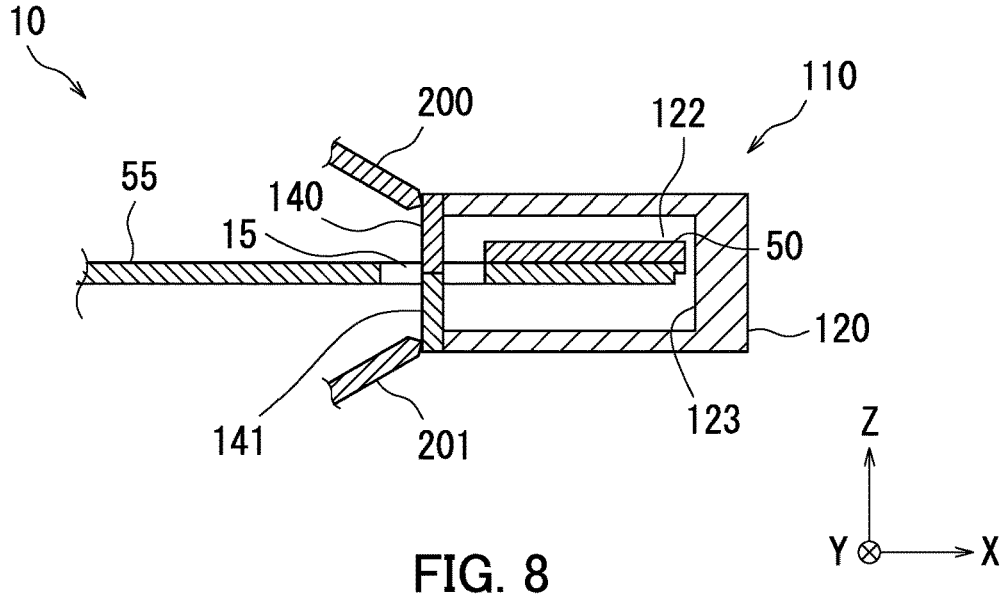
FIG. 8 is a cross-sectional view of the connector and the FFC on completion of the insertion of the FFC into the connector.

Robot work of inserting the FFC 10 into the connector 110 will next be described with reference to FIGS. 1 to 8. FIG. 7 is a cross-sectional view of the connector 110 and the FFC 10 in the process of insertion of the FFC 10 into the connector 110. FIG. 8 is a cross-sectional view of the connector 110 and the FFC 10 on completion of the insertion of the FFC 10 into the connector 110. Since both the end insertion holes 122 are symmetrical to each other, only one of the end insertion holes 122 will be described, and description of the other will be omitted.

As illustrated in FIG. 7, the robot includes a first probe 200 and a second probe 201. The first probe 200 is brought into contact with the base of the first leaf spring 140. The second probe 201 is brought into contact with the base of the second leaf spring 141. The robot applies voltage between the first and second probes 201 and 202. The robot confirms that electrical connection is made between the first and second leaf springs 140 and 141 before insertion of the FFC 10.

The robot moves the FFC 10 relative to the connector 110 in the X-axis positive direction. The end 11 of the FFC 10 is moved into the central insertion hole 121 and the end insertion holes 122 toward the inner wall 123 while elastically deforming the respective tips of the first and second leaf springs 140 and 141. The robot detects that the electrical connection between the first and second leaf springs 140 and 141 is broken.

As illustrated in FIG. 8, when the reinforcement plate 50 passes between the first and second leaf springs 140 and 141, the insertion of the FFC 10 into the connector 110 is completed. The terminals 21 of the FFC 10 are electrically connected to the contacts 130. Each of the first and second leaf springs 140 and 141 returns to its own original shape in a corresponding through hole 15. When respective elastic deformations of the first and second leaf springs 140 and 141 are eliminated, the electrical connection between the first and second leaf springs 140 and 141 is restored. Detecting the restoration of the electrical connection between the first and second leaf springs 140 and 141 enables the robot to easily confirm assembly completion of the FFC 10. Note that cuts may be formed in the FFC 10 in place of the through holes 15.

The robot confirms that the assembly of the FFC 10 is completed in each of the end insertion holes 122. This enables the robot to detect whether or not the FFC 10 is half-inserted. The state in which the FFC 10 is half-inserted means a state in which a connection failure occurs in at least part of all the terminals 21 of the FFC 10. Note that the first to fourth leaf springs 140 to 143 also serves to prevent the FFC 10 from coming off the connector 110.

Figure 9:
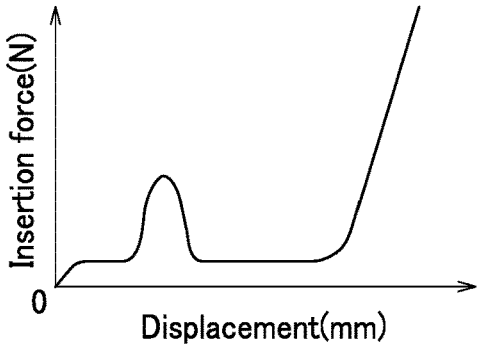
FIG. 9 illustrates a change in an insertion force against FFC displacement when the FFC as depicted in FIG. 3 is inserted into the connector as depicted in FIG. 1.

Detection of an insertion force by the robot will next be described with reference to FIG. 9. FIG. 9 illustrates a change in the insertion force against displacement of the FFC 10 when the FFC 10 as depicted in FIG. 3 is inserted into the connector 110 as depicted in FIG. 1.

In FIG. 9, a horizontal axis represents displacement (mm) of the FFC 10. A vertical axis represents the insertion force (N) detected by a pressure sensor of the robot.

When the end 11 of the FFC 10 hits the first and second leaf springs 140 and 141, the insertion force exhibits one peak because a force for elastically deforming the first and second leaf springs 140 and 141 is required. Subsequently, the insertion force becomes constant for a time period and then exhibits an inclination diagonally up to the right as illustrated in FIG. 9 because a large force is required to electrically connect the terminals 21 of the FFC 10 to the contacts 130. The robot can also confirm, based on a change history (log file) of the insertion force, that the assembly of the FFC 10 is completed.

Figure 10:
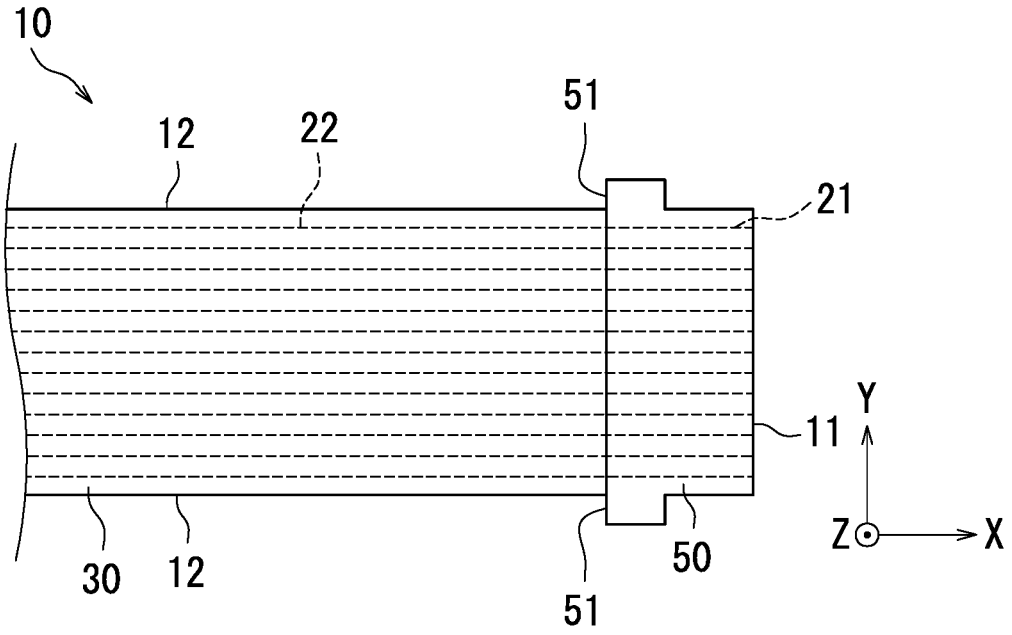
FIG. 10 is a plan view of an FFC in another example.

Another example of the FFC 10 will next be described with reference to FIG. 10. FIG. 10 is a plan view of an FFC 10 of another example.

The FFC 10 depicted in FIG. 10 differs from the FFC 10 depicted in FIGS. 3 to 6 in that a reinforcement plate 50 in FIG. 10 includes ears 51 at both ends of the reinforcement plate 50 in the Y-axis direction. This enables the robot to confirm that assembly of the FFC 10 is completed when the ears 51 pass between first and second leaf springs 140 and 141.

Figure 11:
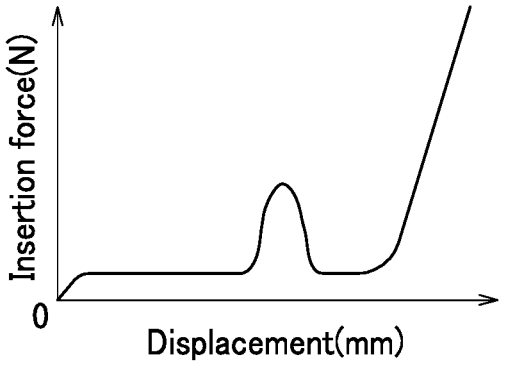
FIG. 11 illustrates a change in an insertion force against FFC displacement when the FFC as depicted in FIG. 10 is inserted into the connector as depicted in FIG. 1.

FIG. 11 illustrates a change in an insertion force against displacement of the FFC 10 when the FFC 10 as depicted in FIG. 10 is inserted into the connector 110 as depicted in FIG. 1.

The graph depicted in FIG. 11 differs from the graph in FIG. 9 in that a time period in which the insertion force is constant after one peak in FIG. 11 is shorter than the time period in which the insertion force is constant after the one peak in FIG. 9. The shorter time period in which the insertion force is constant reflects that respective dimensions of the ears 51 in the X-axis direction are smaller than a dimension of the reinforcement plate 50 in the X-axis direction.

The embodiment of the present disclosure has been described with reference to FIGS. 1 to 11. Note that the present disclosure can be implemented in various modes without departing from the gist of the present disclosure and is not limited to the above embodiment.

Although the embodiment of the present disclosure provides for example the connector 110 that allows the FFC 10 to be inserted therein, the present disclosure is not limited to this. The connector 110 may be configured to allow an FPC to be inserted therein.

Although the embodiment of the present disclosure provides the first to fourth leaf springs 140 to 143 each of which has an elongated plate shape, the present disclosure is not limited to this. Respective tips of the first to fourth leaf springs 140 to 143 may be wavy in shape so that the first to fourth leaf springs 140 to 143 have their respective adjustable insertion forces.

What is claimed is:

1. A connector, comprising:

a connector body having an insertion hole that allows a connection member to be inserted thereinto, the connection member having a plate shape or a sheet shape;

a plurality of contacts;

a first elastic member; and a second elastic member, wherein the insertion hole is divided into a central insertion hole, a first end insertion hole, and a second end insertion hole, in a widthwise direction of the connection member, the central insertion hole is located at a central part of the connecter body, the first end insertion hole is located at one of ends of the connector body, and the second end insertion hole is located at another one of the ends of the connector body, the widthwise direction intersecting an insertion direction of the connection member, the central insertion hole, the first end insertion hole, and the second end insertion hole communicate with one another, the central insertion hole is narrower in a thickness direction of the connection member than the first and second end insertion holes, the thickness direction intersecting the insertion direction and the width direction, the contacts are each supported by the connector body behind the central insertion hole, and the first and second elastic members each include a base fixed to an edge of the first end insertion hole, and are elongated in the thickness direction of the connection member and butted against each other so as to partially block the first end insertion hole.

2. The connector according to claim 1, wherein a longitudinal direction of each of the first and second elastic members is parallel to the thickness direction.

3. The connector according to claim 1, wherein each of the first and second elastic members is a leaf spring.

4. The connector according to claim 1, further comprising:

a third elastic member; and a fourth elastic member, wherein the third and fourth elastic members each include a base fixed to an edge of the second end insertion hole, and are elongated in the thickness direction of the connection member and butted against each other so as to partially block the second end insertion hole.

* * * * *